US006568400B1

(12) United States Patent
Tinsky et al.

(10) Patent No.: US 6,568,400 B1
(45) Date of Patent: May 27, 2003

(54) DUAL FUNCTION WATER PIPE

(76) Inventors: Steve R. Tinsky, 8009 N. Ola. Ave., Tampa, FL (US) 33604; Soji Fujita, 4606 Glenside Cir., Tampa, FL (US) 33624

( * ) Notice: Subject to any disclaimer, the term of this patent is extended or adjusted under 35 U.S.C. 154(b) by 0 days.

(21) Appl. No.: 09/683,797

(22) Filed: Feb. 15, 2002

(51) Int. Cl.[7] ..... A24F 1/30

(52) U.S. Cl. ..... 131/173; 131/175; 131/178; 131/187; 131/191; 131/192

(58) Field of Search ..... 131/330, 173, 131/175, 176, 178, 187, 191, 192

(56) References Cited

U.S. PATENT DOCUMENTS 3,902,506 A * 9/1975 Hawie ..... 131/173
4,223,686 A * 9/1980 Murray, Jr. ..... 131/173
4,648,410 A * 3/1987 Seroussi ..... 131/173
4,682,610 A * 7/1987 Freelain ..... 131/173
5,458,106 A * 10/1995 Kim ..... 131/173
5,476,110 A * 12/1995 Baig et al. ..... 131/173
6,453,908 B1 * 9/2002 Caballero ..... 131/173

* cited by examiner

*Primary Examiner*—Steven P. Griffin
*Assistant Examiner*—Carlos Lopez
(74) *Attorney, Agent, or Firm*—Ronald E. Smith; Smith & Hopen, P.A.

(57) ABSTRACT

A dual function water pipe includes a water-holding container and serves as a loose leaf tobacco pipe and as a cigarette smoking device. A bowl surmounts the container and a downspout of the bowl extends into the container an extent sufficient to submerge the free end of the downspout. A hollow adapter having a radial bore that holds the unlit end of a cigarette surmounts the bowl. A smoker applies suction to a smoke tube that draws smoke from the cigarette and the structure of the device causes the smoke to follow a path of travel that constrains the smoke to pass through the water before entering the smoke tube, removing some toxins from the smoke. The smoke tube is positioned one hundred eighty degrees from the cigarette and has a telescopically-extended configuration that positions a flame source a safe distance from a user's face.

12 Claims, 3 Drawing Sheets

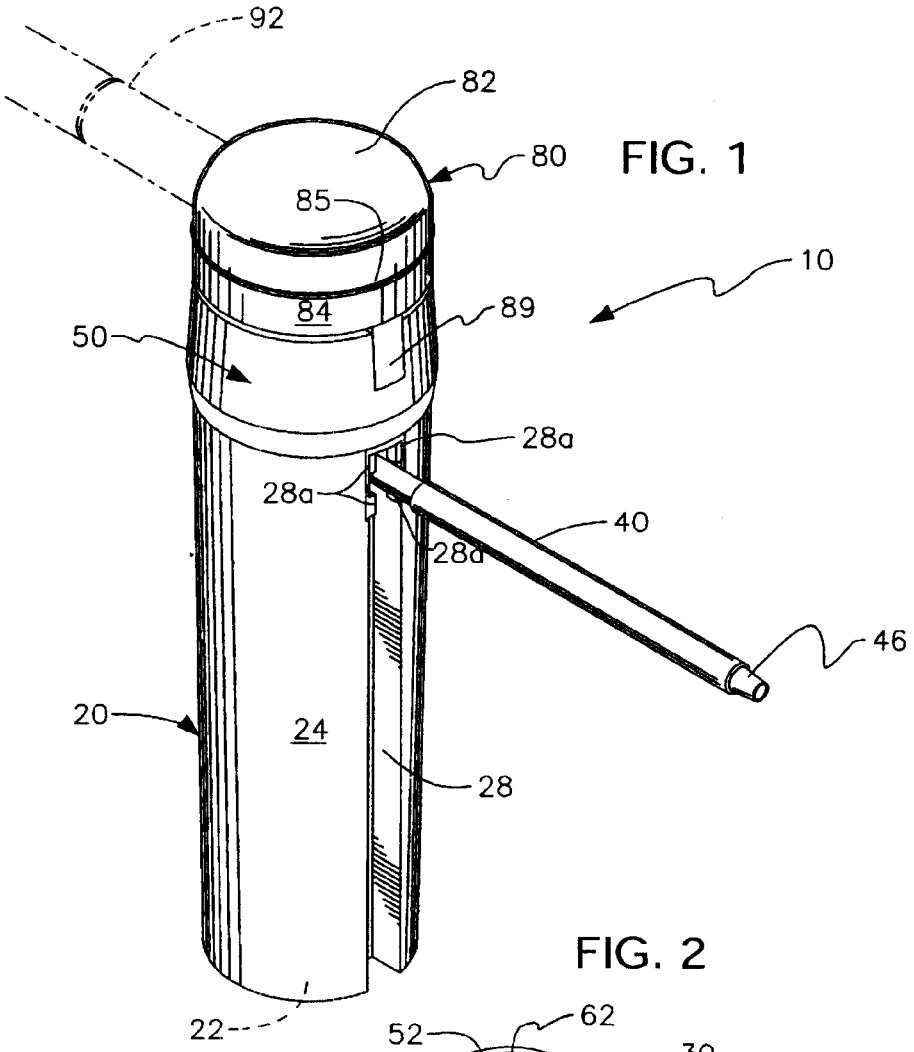
FIG. 1
FIG. 2
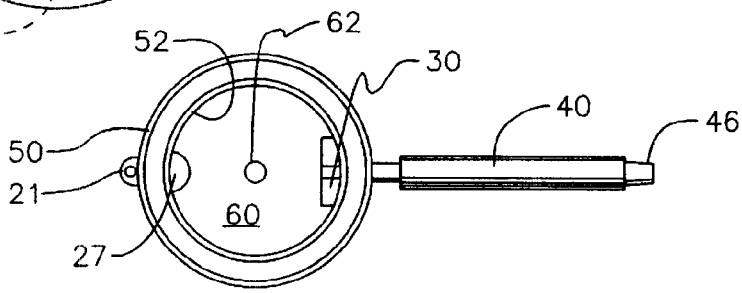

DUAL FUNCTION WATER PIPE

BACKGROUND OF INVENTION

1. Field of the Invention

This invention relates, generally, to devices that reduce toxins in tobacco smoke. More particularly, it relates to a device that at least partially filters unhealthy substances such as tar from tobacco smoke.

2. Description of the Prior Art

The prior art most relevant to the present disclosure is believed to be a water pipe disclosed in U.S. Pat. No. 4,223,686 to Murray, Jr. The device disclosed by Murray, Jr. has utility as a pipe for smoking loose leaf tobacco. It constrains smoke from tobacco leaves to flow through water so that the smoke is cleansed by the time it reaches the smoker. However, the Murray, Jr. device has no utility in connection with cigarettes.

What is needed, then, is a water pipe construction that has utility as a loose leaf tobacco water pipe and as a cigarette water pipe as well.

Upon fulfillment of that need, there then exists a need for a water pipe that removes some tar and other undesirable toxins from loose leaf tobacco and cigarette smoke.

The Murray, Jr. water pipe and other known water pipes are relatively large in size.

As a result, they are burdensome to carry and cannot be stored in convenient places such as the inside of a cigarette pack.

A water pipe about a fourth or a third the size of the Murray, Jr. water pipe would be desirable for several reasons. For example, a smaller water pipe would be easier to carry and could fit into a cigarette pack. Moreover, if overturned or turned onto its side, there would be less water to spill. However, if a water pipe such as the Murray, Jr. water pipe is simply scaled down in size, then the smoke pipe thereof would be unacceptably short. A short smoke pipe would position a flame source too close to a user's face when loose leaf tobacco is lit.

Accordingly, there is a need for a water pipe construction having a small structure but which positions the user's face a safe distance away from a flame source when the water pipe is used.

A small water pipe would be easily lost. A need therefore exists for a means that makes it easier for the owner of a small water pipe to avoid losing it.

Prior art water pipes lack means for holding a cigarette and therefore lack means for aligning a cigarette so that it is always a maximum distance from the user's face. Ideally, the face of the smoker should be diametrically opposed to the cigarette when a water pipe is in use. A need therefore exists for a water pipe structure that positions a cigarette one hundred eighty degrees (180°) from the smoker's face.

It is also difficult to fill a prior art water pipe to the proper level. Conventional water pipes typically include a fill-indicator line etched into the interior wall of the structure, but such line is hard to see.

A better means for indicating the ideal water level within a water pipe is therefore needed.

However, in view of the prior art considered as a whole at the time the present invention was made, it was not obvious to those of ordinary skill in the pertinent art how the identified needs could be met.

SUMMARY OF INVENTION

The long-standing but heretofore unfulfilled need for a water pipe having dual utility as a loose leaf tobacco water pipe and as a cigarette water pipe is now met by a new, useful, and nonobvious invention. The novel device also allows smokers to continue smoking loose leaf tobacco and cigarettes while having some of the negative health aspects thereof reduced.

The pipe includes a container having a flat, imperforate bottom wall. A substantially cylindrical sidewall is mounted about the periphery of the imperforate bottom wall and projects upwardly therefrom to define a container cavity that is adapted to hold a predetermined amount of liquid fluid, preferably water.

A vent means is formed in the substantially cylindrical sidewall of the container and a smoke tube is pivotally secured to the container. The smoke tube has a first, deployed position where a lumen thereof is disposed in fluid communication with the vent means and has a second, storage position where said lumen is not in fluid communication with the vent means. The smoke tube has a distal free end adapted to be placed between the lips of a smoker when the smoke tube is in the first, deployed position.

Significantly, the novel water pipe has about one third to one-fourth the volume of the Murray, Jr. water pipe. This is achieved, in part, by providing a smoke tube of telescopic construction. When fully extended, the length of the smoke tube is sufficient to position the water pipe at a safe distance from the smoker's face. When fully retracted, the smoke tube fits into a truncate storage area. The novel water pipe is so small that it fits into a standard cigarette pack (the pack that holds twenty cigarettes) after a few cigarettes have been removed therefrom.

A channel-shaped recess is formed in an exterior surface of the substantially cylindrical sidewall of the container. The recess extends from the container bottom wall to an uppermost end that is spaced slightly downwardly from an uppermost end of the container. The smoke tube is at least partially received within the recess when the smoke tube is in its collapsed, storage position.

A bowl surmounts the container and has a bottom wall with a longitudinally-extending passageway formed therein. A sidewall mounted about a periphery of the bottom wall defines-a bowl cavity adapted to hold loose leaf tobacco. A tubular downspout depends from the bowl; the tubular downspout has a lumen in fluid communication with the passageway. The distal end of the downspout is disposed in the container cavity in predetermined spaced relation to the imperforate bottom wall of the container.

A cigarette-holding adapter means having a hollow interior removably caps the bowl. A hollow neck depends from the hollow adapter means and fits into the bowl cavity. The neck has an external diameter only slightly less than an internal diameter of the bowl cavity and is received within the bowl cavity when the pipe is in a fully assembled configuration. A radial bore is formed in the adapter means and is adapted to snugly receive therein an unlit end of a cigarette. The radial bore is in fluid communication with the hollow interior of the adapter means. A stop means in the hollow interior spaces the unlit end of the cigarette away from the interior wall of the adapter means so that air can circulate through the cigarette as required for combustion.

When the bowl is properly attached to the container in surmounting relation thereto, the bowl is in a preselected position of rotational adjustment.

The adapter means, when properly installed, fits into the bowl in only one rotational position of adjustment so that the radial bore and hence the cigarette it holds are one hundred eighty degrees (180°) from the smoke tube.

An easily visible protrusion near the bottom of the container indicates the proper water depth for the convenience of the user.

A mounting member having a central opening formed therein is formed on an external surface of the container at the rim thereof so that the novel water pipe may be placed on a key ring, a necklace, or the like, to minimize the chances of loss.

Accordingly, the pipe has utility as a loose leaf tobacco water pipe when the adapter means is not employed and as a cigarette water pipe when the adapter means is employed. In both uses, water is introduced into the container cavity to a predetermined depth sufficient to submerge the distal end of the downspout, such predetermined depth being indicated by the easily visible protrusion.

To use the pipe as a loose leaf tobacco water pipe, the teachings of the Murray, Jr. disclosure are generally followed.

To use the pipe as a cigarette water pipe, the container is filled with water to the proper level, the bowl is screwed onto the container in surmounting relation thereto and in a preselected rotational alignment therewith, the adapter means is properly rotationally aligned with and engaged to the bowl, the unlit end of a cigarette is press fit into the radial bore formed in the adapter means until it abuts the stop member in the hollow interior of the adapter means, the smoke pipe is deployed and telescopically extended, and the cigarette is lit.

In a preferred embodiment, screw threads join the bowl and the container so that the preselected position of rotational adjustment of the bowl relative to the container is achieved when the bowl is fully engaged to the container. This ensures that an adapter-alignment means formed in the bowl will be properly positioned so that when the adapter means is press fit into the bowl, the radial bore into which a cigarette is inserted will be one hundred eighty degrees from a user's face.

A user deploys the telescoped smoke tube by extending it to its maximum length and applies suction to the distal end of the smoke tube, pulling smoke along a path of travel that begins at the burning end of a cigarette, extends through the length of the cigarette, through the radial bore and into the hollow interior of the adapter means, through the lumen of the downspout, from the submerged distal end of the downspout, through the liquid fluid, into the container cavity, and to the smoker through the vent means and the smoke tube.

Toxins in the smoke are collected to at least some extent by the liquid fluid so that smoke reaching the user has a reduced toxin content relative to smoke that travels directly from a cigarette to a smoker.

A primary:object of the invention is to provide a water pipe having utility as a loose leaf tobacco water pipe and as a cigarette water pipe.

Another major object is to provide a water pipe that reduces the quantity of toxins received by a smoker when smoking.

Another important object is to provide a water pipe that is sufficiently small to fit within a standard cigarette pack.

Still another object is to provide an improved smoke tube so that a smoker's face is positioned a substantial distance from the water pipe, while still maintaining the small size of the novel water pipe.

Yet another object is to provide a means for positioning a cigarette one hundred eighty degrees from the smoker's face.

Another object is to provide a water pipe having a structure that better indicates to a user how to properly charge the pipe with water.

Yet another object is to provide a water pipe structure that enables a user to avoid losing the water pipe.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which:

FIG. 1 is a perspective view of an illustrative embodiment of the invention;

FIG. 2 is a top plan view thereof when the novel adapter has been removed;

DETAILED DESCRIPTION

Figure 3:
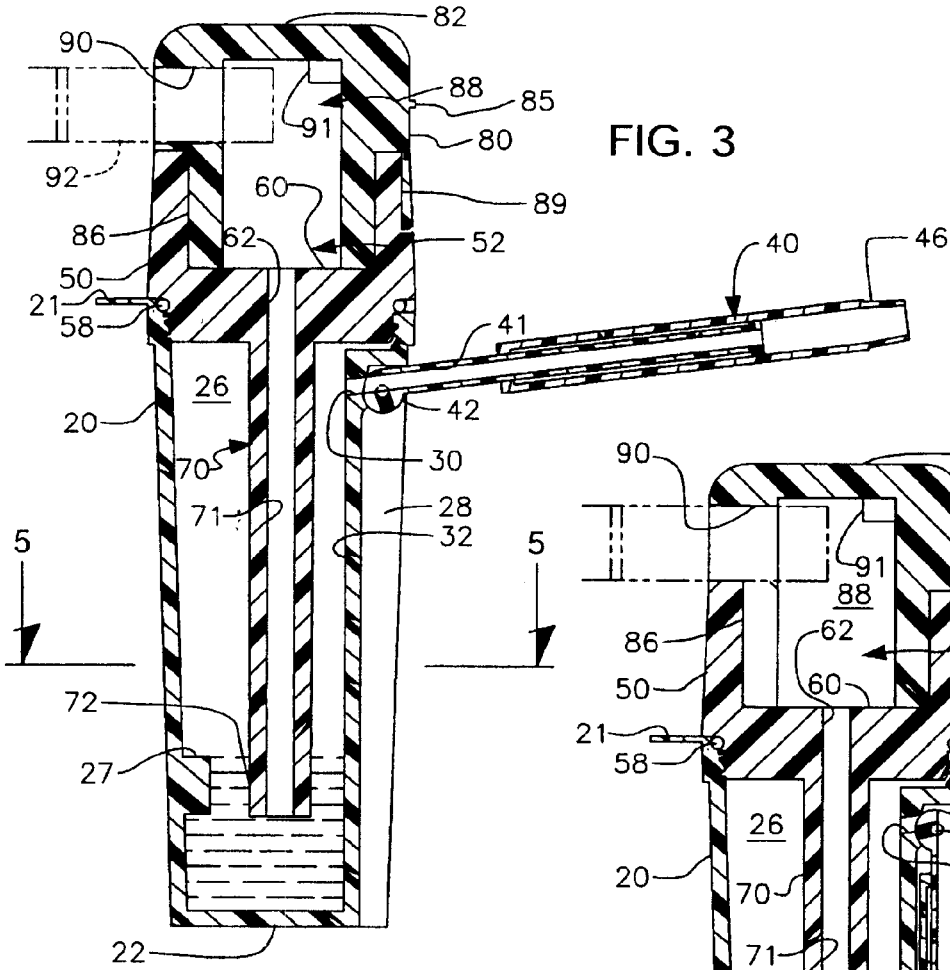
FIG. 3 is a longitudinal sectional view depicting the smoke tube in its deployed configuration.

Referring to FIGS. 1–6, it will there be seen that the reference numeral 10 denotes an illustrative embodiment of the present invention as a whole.

The major structural parts of pipe 10 include container 20, smoke tube 40, bowl 50, tubular downspout 70 (FIG. 3), and adapter means 80. These parts are preferably made of a heat-resistant plastic.

Container 20 includes imperforate bottom wall 22 and substantially cylindrical sidewall 24 mounted about the periphery of said bottom wall. Sidewall 24 projects upwardly from bottom wall 22 and cooperates therewith to define an open-topped container cavity 26 (FIGS. 3 and 4).

An elongate, channel-shaped recess 28 is formed in an exterior surface of substantially cylindrical sidewall 24 and extends from bottom wall 22 to an uppermost end that is spaced slightly downwardly from the uppermost end of container 20.

A vent means in the form of radial passageway 30 (FIGS. 2 and 3) is formed in bottom wall 32 of recess 28 near the uppermost end of said recess. Vent means 30 provides a passageway from container cavity 26 to the external environment.

Figure 4:
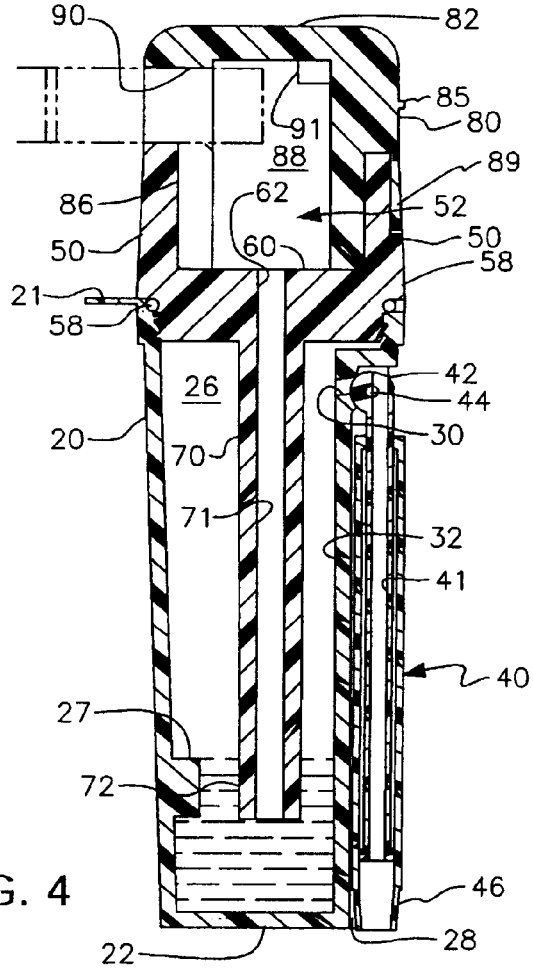
FIG. 4 is a longitudinal sectional view depicting the smoke tube in its folded, storage configuration.
Figure 5:
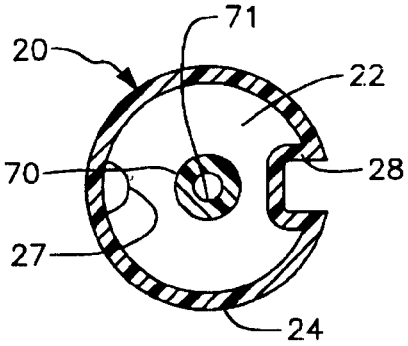
FIG. 5 is a transverse sectional view taken along line 5—5 in FIG. 3.

Lumen 41 of smoke tube 40 is in fluid communication with vent means 30 when said smoke tube is in a first, deployed position, as depicted in FIG. 3. Specifically, proximal end 42 of smoke tube 40 is slightly enlarged with respect to the balance of smoke tube 40 as depicted in FIGS.

3 and 4. Slightly enlarged proximal end 42 is secured to pivot pin 44 (FIG. 4) that is positioned at the upper end of recess 28. Proximal end 42 is restrained from displacement along the extent of recess 28 by detent means collectively denoted 28*a* (FIG. 1). Said detent means do not constrain smoke tube 40 from pivoting about pivot pin 44. In this way, smoke tube 40.has a second, storage position where it is folded at least partially into recess 28, as depicted in FIG. 4, said recess having a depth slightly less than the diameter of said smoke tube. When smoke tube 40 is in said second, storage position, lumen 41 is not in fluid communication with vent means 30 as depicted in FIG. 4.

Detent means 28*a* are preferably spaced apart from one another by a distance slightly less than the diameter of the reduced diameter section of smoke pipe 40 so that said smoke pipe 40 is firmly held in its operable position by said detent means when said smoke pipe is operatively deployed as depicted in FIGS. 1 and 3. The detent means and the smoke tube are made of slightly compressible material so that the smoke tube is easily rotatable into its storage position when not in use. When a user rotates smoke tube 40 from its storage position (FIG. 4) to its operable, FIG. 1 position, a distinct snapping-into-position movement is felt as detent means 38*a* are collectively and momentarily compressed and released as the smoke tube is rotated into position.

Smoke tube 40 has a telescoping construction as depicted so that distal free end 46 of smoke tube 40 is substantially co-extensive with bottom wall 22 of container 20 when the smoke tube is telescopically collapsed to its shortest length and is in said second, storage position, as depicted in FIG. 4. Distal free end 46 is therefore easy to manually grasp when it is desired to rotate the smoke tube into its operable position. Smoke tube 40 can be pivoted at least ninety degrees so that it forms a right angle with container 20. Smoke tube 40 may also rotate a little more than ninety degrees if pivot member 44 is not positioned at the extreme uppermost end of recess 28, as indicated in FIG. 3. The smoke tube is telescopically elongated before the smoking begins so that the water pipe is a maximum distance from the smoker's lips. As depicted, smoke tube 40 extends radially relative to a longitudinal axis of symmetry of container 20 when said smoke tube 40 is deployed.

Bowl 50 defines a bowl cavity 52 (FIGS. 1 and 2) adapted to hold loose leaf tobacco. It surmounts container 20 and shares a common external diameter with said container. External screw threads are formed in a slightly reduced diameter neck that depends from bowl 50. Said screw threads screw threadedly engage internally threaded screw threads formed in the uppermost end of container 20. These screw threads and the slightly reduced diameter neck are depicted in FIGS. 3 and 4 but are unnumbered to avoid cluttering the drawings. O-ring 58 is sandwiched between bowl 50 and the uppermost rim of container 20 when said bowl screw threadedly engages said container.

The screw threads are specifically formed so that bowl 50 has a preselected position of rotational adjustment relative to container 20 when said bowl is fully screw threaded into said container. Other means, such as a press fit, could be employed to secure bowl 50 to container 20, but a means for aligning the bowl in a preselected position of rotational adjustment relative to container 20 must be maintained to ensure that cigarette 92 is one hundred eighty degrees (180°) from the smoker's lips during a smoking session as indicated in FIG. 1.

In lieu of screw threaded engagement, bowl 50 could also be dimensioned for press fit engagement into the uppermost end of container 20, but the diametrically opposed relation between smoke tube 40 and cigarette 92 should be maintained.

Bowl 50 has a bottom wall 60 having a central aperture or passageway 62 formed therein, coincident with the longitudinal axis of symmetry of container 20. Central passageway 62 also extends through the above-mentioned reduced diameter neck.

Tubular downspout 70 depends from the slightly reduced diameter neck and lumen 71 thereof is in fluid communication with passageway 62. The length of downspout 70 is preselected so that its distal free end 72 is spaced slightly above bottom wall 22 of container 20 when bowl 50 is screw threadedly engaged to container 20.

Adapter means 80 has an external diameter substantially in common with that of bowl 50 and container 20. In a commercial embodiment, its diameter is slightly less than that of container 20 because bowl 50 has a slight downward taper.

Figure 6:
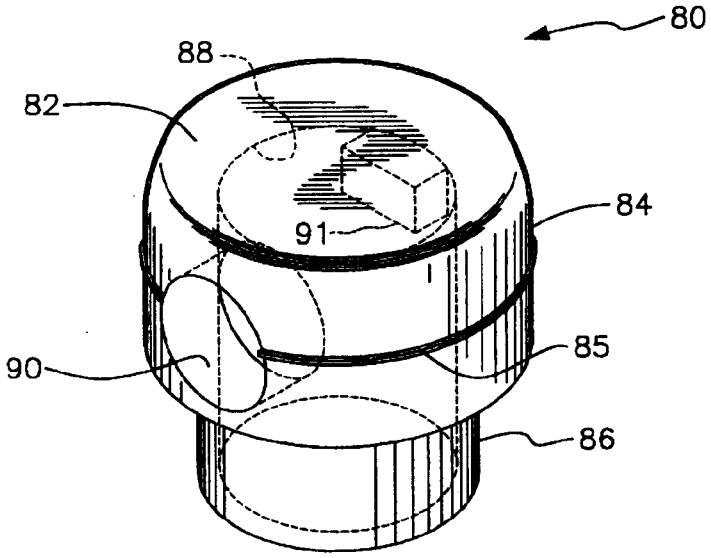
FIG. 6 is a perspective view of the novel adapter.
Figure 7:
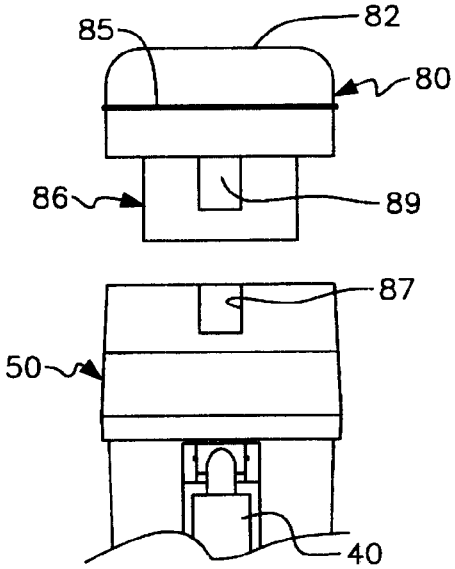
FIG. 7 is a side elevational, exploded view of the adaptor and bowl.
Figure 8:
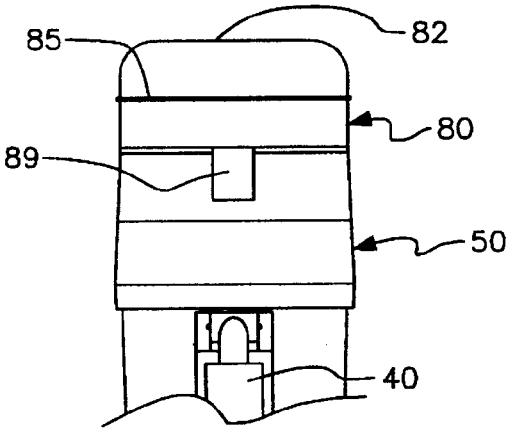
FIG. 8 is a side elevational view of the adaptor and bowl in their assembled configuration.

As best understood in connection with FIGS. 6 and 7, adapter means 80 has a main body that includes an imperforate top wall 82, a cylindrical sidewall 84, and a reduced diameter neck 86 that depends from the main body. The external diameter of neck 86 is slightly less than the internal diameter of bowl cavity 52 and is adapted to be press fit thereinto as depicted in FIGS. 3, 4, and 7. Adapter means 80 is hollow as at 88 (FIGS. 3, 4, and 6) and said hollow interior is coincident with the longitudinal axis of symmetry of container 20. Hollow interior 88 extends through neck 86 and is in fluid communication with lumen 71 of tubular downspout 70 when pipe 10 is in its assembled configuration as depicted in FIGS. 3, 4, and 8.

An annular ridge 85 is formed in circumscribing relation to sidewall 84 to provide a finger grip means to facilitate separation of adapter means 80 from bowl 50.

Radial aperture 90 (FIG. 6) is formed in cylindrical sidewall 84 of adapter means 80 and extends completely therethrough so that its radially innermost end is in open communication with hollow interior 88. The diameter of radial aperture 90 is slightly less than an external diameter of a cigarette butt or filter 92 so that the unlit end of a cigarette may be press fit thereinto. Stop member 91 (FIGS. 3, 4 and 6) holds the non-burning end of the cigarette away from the internal wall of hollow interior 88 so that the smoke may flow freely. A cigarette held by adapter means 80 extends radially with respect to the longitudinal axis of symmetry of container 20.

Adapter means 80 is positioned atop bowl 50 and is press fit thereto such that radial aperture 90 is diametrically opposed to smoke tube 40 when pipe 10 is in use, as depicted in FIG. 1. Detent means 87 (FIGS. 1–3, 7 and 8) in the form of a recess is formed in an outer wall of bowl 50. A mating detent means 89 is formed in adapter 80 in diametrically opposed relation to radial aperture 90. Detent 87 slidingly receives mating detent means 89 when adaptor means 80 is pressed down into mating relation with bowl 50. Significantly, adaptor means 80 cannot be press fit into bowl 50 unless the required rotational alignment of detent means 87 and 89 is made, i.e., adaptor means 80 has only one position of rotational adjustment where it will fit properly onto bowl 50. This ensures that the cigarette will always be diametrically opposed to the smoker's face when the novel water pipe is in use.

In lieu of the preferred press fit engagement, adapter means 80 could be screw threadedly engaged to bowl 50, but means for maintaining the required rotational relationship between the adapter means and the bowl must be maintained.

The novel device is also used as a loose leaf tobacco water pipe, in the manner taught by Murray, Jr., when adapter means 80 is not used. A screen for supporting loose leaf tobacco is positioned atop bowl 50 when loose leaf tobacco is to be smoked. The screen is not depicted because it forms no part of the invention, per se. Easily visible protrusion 27 (FIGS. 2 and 3) indicates a fill line to which water is added when the device is prepared for use.

A flat, centrally apertured mounting means 21 (FIGS. 2-4) is formed integrally with the uppermost rim of container 20 and provides a means whereby the novel water pipe may be secured to a key ring, bracelet, necklace, or the like so that it is not easily misplaced. The mounting means is also useful for hanging the novel water pipes in display advertising in retail stores. A split metal ring, not shown, is received within the central aperture (FIG. 2) of mounting means 21 to facilitate such mounting.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A water pipe assembly, comprising:

a container having a flat, imperforate bottom wall;

a substantially cylindrical sidewall mounted about the periphery of said imperforate bottom wall and projecting upwardly therefrom, defining a container cavity therebetween that is adapted to hold a predetermined amount of liquid fluid;

a vent means formed in said substantially cylindrical sidewall of said container;

a smoke tube pivotally secured to said container;

said smoke tube having a first, deployed position where it is disposed in fluid communication with said vent means;

said smoke tube having a second, storage position where it is not in fluid communication with said vent means;

said smoke tube having a distal free end adapted to be placed between the lips of a smoker when the pipe is in said first, deployed position;

a bowl having a bottom wall with a passageway formed therein and a sidewall mounted about a periphery of said bottom wall to thereby define a bowl cavity, said bowl cavity adapted to hold loose leaf tobacco when said water pipe is used as a loose leaf tobacco water pipe;

said bowl disposed in surmounting relation to said container;

a tubular downspout that depends from said bottom wall of said bowl, said tubular downspout having a lumen in fluid communication with said passageway;

a distal end of said tubular downspout disposed in said container cavity in predetermined spaced relation to said imperforate bottom wall;

an adapter means for removably capping said bowl;

said adapter means having a hollow interior;

a hollow neck that depends from said hollow adapter means and that extends into said bowl cavity when said adapter means caps said bowl;

a radial bore formed in said adapter means, said radial bore adapted to snugly receive therein an unlit end of a cigarette;

said radial bore being in fluid communication with said hollow interior of said adapter means;

whereby liquid fluid is introduced into said container cavity to a predetermined depth sufficient to submerge said distal end of said downspout;

whereby suction applied to said distal end of said smoke tube by a smoker pulls smoke along a path of travel beginning at a burning end of a cigarette, extending through the cigarette to its unlit end, through said radial bore of said adapter means and into said hollow interior, through said downspout, through said liquid fluid, into said container cavity, and to the smoker through said vent means and said smoke tube;

whereby toxins in said smoke are reduced to at least some extent by said liquid fluid so that smoke reaching said smoker has a reduced toxin content relative to smoke that travels directly from a cigarette to a smoker; and whereby a water pipe having utility as a loose leaf tobacco pipe is converted into a cigarette water pipe when said adapter means is fit onto said bowl.

2. The water pipe assembly of claim 1, wherein said smoke tube has a telescopic construction so that a flame source is positioned safely away from a user's face when said smoke tube is telescopically extended and in said first, deployed position.

3. The water pipe assembly of claim 2, further comprising:

an elongate, channel-shaped recess formed in an exterior surface of said substantially cylindrical sidewall;

said recess extending from said bottom wall of said container to an uppermost end that is spaced slightly downwardly from an uppermost end of said container;

whereby said smoke tube is at least partially received within said recess when said smoke tube is telescopically collapsed and in said second, storage position.

4. The water pipe assembly of claim 1, wherein said bowl engages said container in a preselected position of rotational adjustment.

5. The water pipe assembly of claim 4, wherein a bowl screw threadedly engages said container to said bowl and wherein screw threads formed in said bowl and complementary screw threads formed in said container are formed so that when said bowl is fully screw threadedly engaged to said container, said bowl is in said preselected position of rotational adjustment.

6. The water pipe assembly of claim 5, where in said adapter means engages said bowl in a preselected position of rotational adjustment so that said radial bore formed in said adapter means is positioned in diametrically opposed relation to said smoke tube when said adapter means is engaged to said bowl.

7. The water pipe assembly of claim 6, further comprising a detent means formed in said bowl and a ma ting detent means formed in said adapter means so that said adapter means is attachable t o said bowl only when said detent means and mating detent means are in rotational alignment with one another.

8. The water pipe assembly of claim 1, further comprising a protuberance formed in said container cavity to indicate a preferred water level to which said container cavity is filled prior to use of said water pipe.

9. The water pipe assembly of claim 1, further comprising:

a mounting means formed integrally with said container;

said mounting means having an opening formed therein;

said mounting means facilitating connection of said water pipe to a preselected article of a user's choice to minimize the chances of misplacing said water pipe; and said mounting means facilitating display advertising of said water pipe.

10. The water pipe assembly of claim 3, further comprising:

a plurality of detent means disposed near an upper end of said elongate, channel-shaped recess;

said plurality of detent means being spaced apart from one another by a distance slightly less than the diameter of said smoke pipe so that said smoke pipe is firmly held in its operable position by said detent means when said smoke pipe is operatively deployed;

said detent means and said smoke tube being made of slightly compressible material so that the smoke tube is easily rotatable into its storage position when not in use; and said detent means being collectively and momentarily compressed and released as the smoke tube is rotated into its operable position or its storage position.

11. A water pipe assembly, comprising:

a container for holding water, said container having a longitudinal axis of symmetry;

a bowl that surmounts said container, said bowl adapted to hold loose leaf tobacco;

means for securing said bowl to said container in a preselected position of rotational adjustment;

an adapter means that surmounts said bowl;

means for securing said adapter means to said bowl in a preselected position of rotational adjustment;

said adapter means adapted to hold a cigarette in radial relation to said longitudinal axis of symmetry;

a smoke tube attached to said container and having a first, deployed position where it is in fluid communication with a hollow interior of said container and where it extends from said container in radial relation to said longitudinal axis of symmetry;

said means for securing said bowl to said container in a preselected position of rotational adjustment and said means for securing said adapter means to said bowl in a preselected position of rotational adjustment cooperating with one another to position a cigarette held by said adapter means in one hundred eighty degree opposition to said smoke tube.

12. The water pipe assembly of claim 11, wherein said smoke tube has a telescopic construction.

* * * * *